United States Patent [19]

Stoltz

[11] Patent Number: 4,769,867

[45] Date of Patent: Sep. 13, 1988

[54] SWIMMING POOL CLEANING DEVICE

[76] Inventor: Herman Stoltz, 90 Alcade Avenue, Lynnwood, Pretoria, Transvaal Province, South Africa

[21] Appl. No.: 92,626

[22] Filed: Sep. 3, 1987

[30] Foreign Application Priority Data

Sep. 4, 1986 [ZA] South Africa ..... 86/6702

[51] Int. Cl.[4] ..... E04H 3/20

[52] U.S. Cl. ..... 15/1.7; 137/624.14; 251/5

[58] Field of Search ..... 15/1.7; 210/169; 137/624.14; 251/5

[56] References Cited

U.S. PATENT DOCUMENTS 4,351,077 9/1982 Hofmann ..... 15/1.7

4,642,833 2/1987 Stoltz et al. ..... 15/1.7

*Primary Examiner*—Edward L. Roberts

*Attorney, Agent, or Firm*—Banner, Birch, McKie & Beckett

[57] ABSTRACT

A swimming pool cleaning device including a head with a valve automatically operable therein by the flow of water induced by the suction of the swimming pool filtration equipment. The valve is in the form of a pair of jaw-like members resiliently biased to a open position preferably by resilient membranes between the sides of the jaws.

9 Claims, 2 Drawing Sheets

SWIMMING POOL CLEANING DEVICE

INTRODUCTION

THIS INVENTION relates to a device for cleaning a submerged surface, such as in a swimming pool, which device will hereafter simply be referred to as a "swimming pool cleaning device".

BACKGROUND TO THE INVENTION

The swimming pool cleaning device is of the type which operates automatically to move over the surface to be cleaned when water is induced to flow through the device by the suction of the conventional swimming pool filtration equipment. This flow is interrupted, at least to a substantial degree, by a valve in the cleaning head with the result that the device moves step-wise in random fashion over the floor and walls of the swimming pool. This allows the surfaces to be cleaned by water flowing thereover and through the swimming pool cleaning device to the filter unit.

Swimming pool cleaning devices of this type are known and it is the object of this invention to provide an alternative swimming pool cleaning device which is simple to construct and maintain. The known type of pool cleaners include those disclosed in the following U.S. Pat. Nos. 3,803,658 to Raubenheimer, 4,023,227 to Chauvier, 4,133,068 to Hofman and, 4,642,833 to Coxwold (Pty) Limited.

SUMMARY OF THE INVENTION

According to the invention there is provided a swimming pool cleaning device comprising a cleaning head having an inclined passage extending therethrough from an inlet at the end of the passage which in use engages the surface to be cleaned to an outlet having means for connection to a flexible suction hose, a valve within the passage at the end of a rigid tubular section thereof extending from the valve to the passage outlet, the valve being in the form of at least one pair of jaw-like members movable relative to each other, about at least one axis transverse to the length of and adjacent the end of the tubular section, the members tapering towards each other to an inlet between them at their free ends with flexible membranes located between the sides of the jaws.

Further features of the invention provide for the valve to be resiliently biased to retain the inlet thereto open for the jaw-like members each to be movable and movable about a common axis and for the flexible membranes to provide the resilient bias to hold the jaw-like members open.

The invention also provides for only one jaw-like member to be movable and for the movement to be provided through resilient hinge points integral with the sides of the members.

A still further feature of this invention provides for the jaw-like members to be carried at their hinged ends on a peripheral resilient flange the outer part of which is mounted on the rigid tubular section of the passage.

These and other features of the invention will become more apparent from the following description of different embodiments thereof set out below by way of example with reference to the accompanying essentially diagrammatic drawings.

DETAILED DESCRIPTION OF THE DRAWINGS

Figure 1:
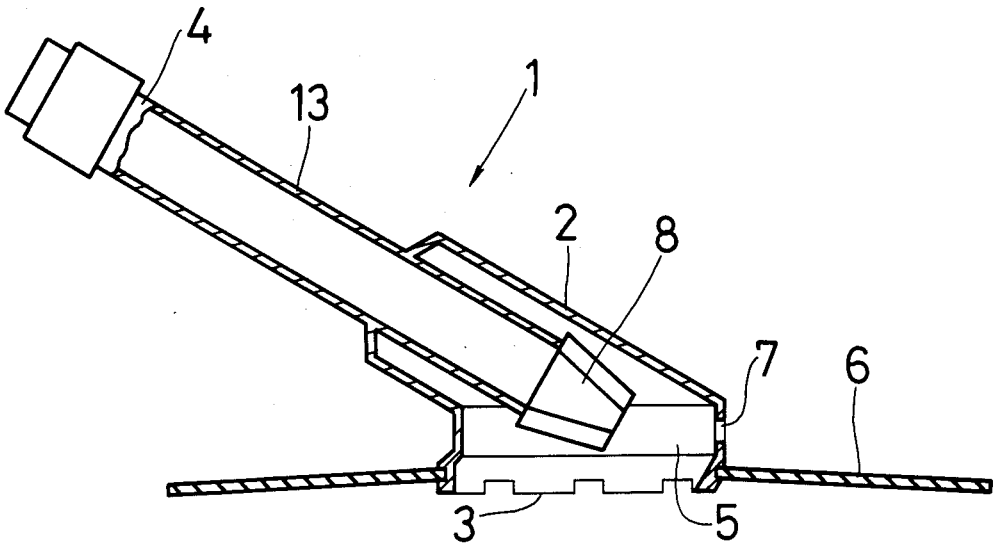
FIG. 1 is a cross-sectional side elevation of a swimming pool cleaning device of this invention.

Referring to FIG. 1, reference numeral 1 generally indicates a swimming pool cleaning device comprising a head 2 having an inlet 3, and an outlet 4. A flow passage 5 is provided between the inlet 3 and the outlet 4 and also a flexible circular surface engaging disc 6 surrounds the inlet 3.

The head 2 is also provided with ports 7, above the disc 6, serving as an additional inlet for water to the head 2.

A valve 8 is provided in the flow channel 5 between the inlet 3 and the outlet 4.

Figure 2:
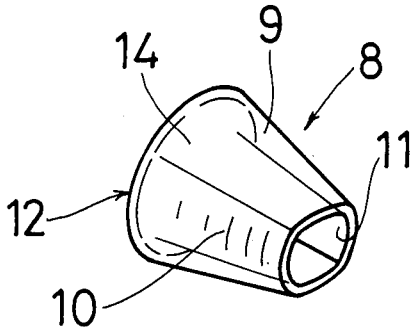
FIGS. 2 to 6 illustrate alternative examples of the valve mechanism for the pool cleaning device.
Figure 3:
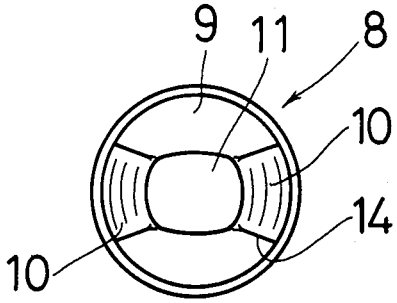

The embodiment of the valve 8 which is shown in greater detail in FIGS. 2, 3 is made from a suitable resilient or flexible synthetic plastics material and consists a pair of jaw-like members 9 with a flexible membrane 10 on each side between the members 9. The valve 8 has a front inlet opening 11, facing against the direction of fluid flow in the flow channel 5, and a rear opening 12. The front opening 11 is preferably elongate or substantially oval-shaped but may also be of any suitable shape to allow opening and closing and is about equal to or smaller than the rear opening in cross sectional area. As shown, the jaw-like members 9 converge towards the front end of the valve 8. The valve 8 is biased to the open position by virtue of inherent resilience which is incorporated therein preferably through the membranes 10. However, the copy may itself provide the required bias. The construction of the valve 8 is also such that when a substantially uniform outside pressure is exerted over its entire outside area, the forces acting on the valve body will tend to force the valve into an open position. Thus in the static position the valve will always move to the open position.

The flow passage 5 between the valve 8 and the outlet 4 consists of a rigid tubular section 13 of a predetermined length. This length is found in practice, to be about 40 cms and ensures that the valve operates effectively and at an even rate.

In use, the outlet 4 is connected, by means of a swivel connection, to a flexible suction hose (not shown) of conventional type which in turn is connected to the suction intake of a swimming pool filtration pump.

When suction is applied to the outlet 4, water flows through the flow passage 5. When the flow velocity reaches a critical value, this causes the valve 8 to close or at least partly to close by virtue of the fluid, external of the valve, exerting an inward resultant force on the inclined forward facing outside surfaces of the valve 8. The pressure inside the valve 8, as a result of the fluid flow therethrough is reduced compared to the static pressure. When closed or partly closed, the water flow is abruptly interrupted for a brief period. Under these circumstances the pressure within the valve 8 increases to the static condition and the forces acting on the jaw-like members 9 cause the valve to re-open.

After the valve 8 has returned to the open position the cycle is repeated resulting in the intermittent opening and closing of the valve 8.

The result of the intermittent interruption of flow of water through the passage and particularly the rigid section 13 thereof to the flexible suction hose, is that there is an equivalent release of the suction induced under the disc 6 which is consequently released from contact with the surface being cleaned. Substantially simultaneously resultant forces acting on the head cause the latter to move in stepwise and random manner over the surface with which the inlet 3 is in contact. This action is well-known from the swimming pool cleaners made in accordance with the United States Patents above referred to and need not be described in greater detail here.

Also the water flowing over the surface being cleaned into the head 2 entrains dirt and debris and thus cleans that surface.

It has been found that the frequency of the pulsating action is influenced by the length and diameter of the rigid tubular section 13, as well as the shape and size of the front opening of the valve 8, the angle of inclination of the tapered outer surfaces of the jaw-like members 9 and the resilience or elasticity of the material from which the valve is made. These parameters may be selected to provide a desirable pulse rate and speed of movement of the cleaning device over the surface being cleaned.

The valve illustrated in FIG. 2, 3 can be made with separate components but is preferably an integrated moulding from plastics material. The jaw-like members 9 are made to be substantially rigid but joined with some flexibility at the outlet. The side membranes 10 are both resilient and flexible such that an inherent bias to push open the free ends of the jaw-like members 9. This is achieved by moulding the valve in such a way that when the valve is closed compressive stresses are created in the membranes 10 which tend to bulge. When the external forces are released the membranes forcibly return to their unstressed condition which assists in returning the valve to the open position.

The embodiment of FIGS. 2 and 3 shows the jaw-like members 9 each being movable about independant axes of movement 14.

Figure 4:
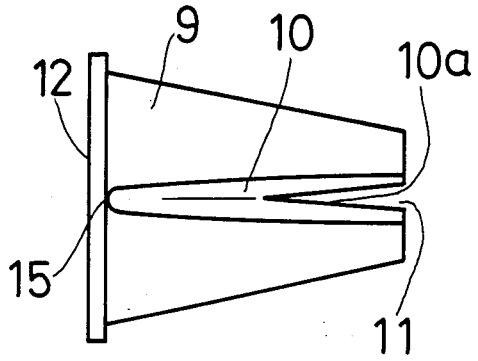
Figure 5:
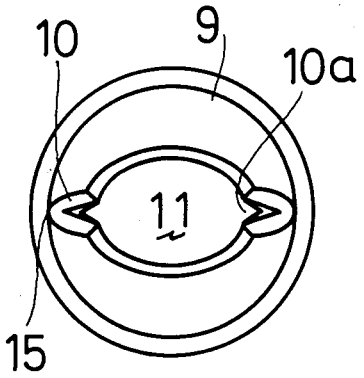

In FIGS. 4 and 5 one of the jaw-like members 9 of the valve 8 is fixed relative to the rigid section 13 and only the other member 9 movable about an axis 15. The inlet and outlet areas of the valve may be approximately equal but it is important that the outside surface of the valve taper inwardly towards the inlet opening as shown in all the valves illustrated. In FIGS. 4 and 5 a slit 10*a* is provided at the inlet end of the resilient membrane 10. This is to relieve the bias towards the open position of the valve at this area to facilitate closing.

In all cases the valve is constructed to attain the proper bias to the open position so that flow through the valve will enable the jaw-like members 9 to close under the then existing pressure conditions. Otherwise the construction is similar in its operation to that described with reference to FIGS. 2 and 3.

Figure 6:
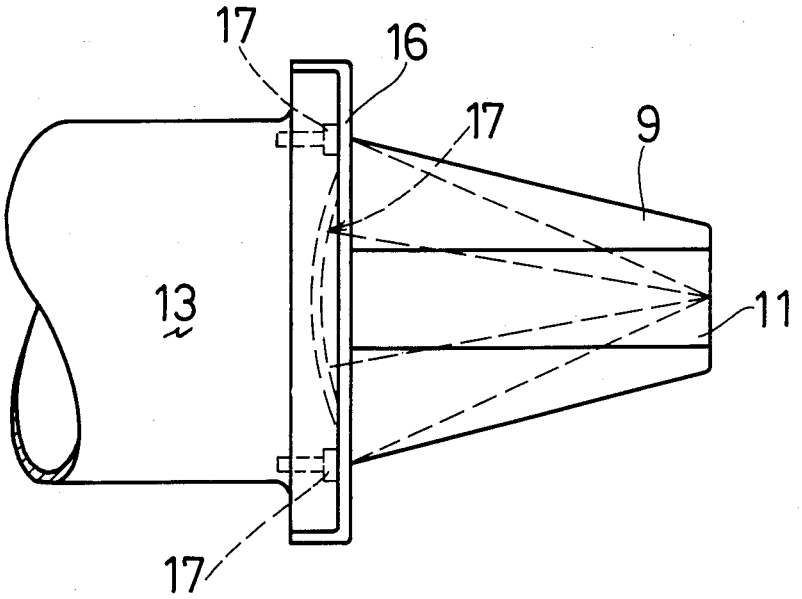

The embodiment of the valve illustrated in FIG. 6 is substantially different from that described above but achieves a similar automatic opening and closing during use.

The valve 8 of this embodiment is basically similar to the valve described with reference to FIGS. 2 and 3 and it has a pair of relatively movable jaw-like members 9 with a flexible membrane 10 on each side between the members 9. It also has an elongate or oval-shaped front inlet opening 11 and a circular rear outlet opening 12, which is approximately equal to or greater in cross-sectional area than front end. In addition this valve 8 is provided with a peripheral flange 16 through which it is attached to the end of the tubular section 13. The resilience of the flange provides a bias to hold the jaws in an open position.

There are provided constraining stops 17 which cooperate with the tubular member 13 to prevent the flange 16 from flexing inwardly at the central outside edges of the jaw-like members 9.

In use the valve 8 of this embodiment, closing of the jaw-like members 9 during fluid flow therethrough will be caused by the same forces as in the case with the valves above described. However, flow through the valve 8 results in increased pressure on the upstream face of the flange 16, indicated by the arrows 17. This will cause the flange 16 to flex inwardly adjacent the sides of the jaw-like members 9 only because the stops 17 prevent the flange 16 from this flexing action at their central outside edges. This will force the members 9 to close as a result of the flexing of the unrestrained areas flange 16 inwardly into the end of the rigid section 13 of the passage 5 through the head 2. This is indicated in broken lines in FIG. 6. The flexing induces stresses in the flange 16 tending to return the valve 8 to the open position immediately the forces caused by flow of water through the valve are released by closure of the valve 8.

It will be appreciated that there can be many variations to the actual forms of the valve 8 described above without departing from the scope of the invention. For example resilient loading of the valve to the open position can be effected otherwise than through the inherent resistance of the material from which the valve is made.

The invention provides a simple construction for interrupting the flow of fluid through a swimming pool suction cleaning device which will enable the device to move automatically over the surfaces to be cleaned.

Details of the balancing means for devices of this type are well-known at this time in the art and need not be set out herein.

What I claim as new and desire to secure by Letters Patent is:

1. A swimming pool cleaning device comprising a cleaning head having an inclined passage extending therethrough from an inlet at the end of the passage which in use engages the surface to be cleaned to an outlet having means for connection to a flexible suction hose, a valve within the passage at the end of a rigid tubular section thereof extending from the valve to the passage outlet, the valve being in the form of at least one pair of jaw-like members movable relative to each other about at least one axis transverse to the length of and adjacent the end of the tubular section, the members tapering towards each other to an inlet beween them at their free ends with flexible membranes located between the sides of the jaws.

2. A swimming pool device as claimed in claim 1 in which the valve is resiliently biased to retain the inlet thereto open.

3. A swimming pool device as claimed in claim 1 or 2 in which the jaw-like members are each movable and are movable about a common axis.

4. A swimming pool cleaning device as claimed in claim 2 in which the membranes provide the bias to the jaws to hold the inlet open.

5. A swimming pool cleaning device as claimed in claim 1 in which only one member is movable.

6. A swimming pool cleaner as claimed in claim 1 in which movement of the jaw-like members is provided through resilient hinge points integral with the sides of the members.

7. A swimming pool cleaning device as claimed in claim 6 in which the jaw-like members are carried at their hinged ends on a peripheral resilient flange the outer part of which is mounted on the rigid tubular section of the passage.

8. A swimming pool cleaning device as claimed in claim 1 wherein the inlet opening does not completely close in use.

9. A swimming pool cleaning device as claimed in claim 8 in which the inlet opening is of oval shape.

* * * * *